United States Patent [19]

Ireland et al.

[11] 4,041,097

[45] Aug. 9, 1977

[54] METHOD FOR ALTERING THE PRODUCT DISTRIBUTION OF FISCHER-TROPSCH SYNTHESIS PRODUCT

[75] Inventors: Henry R. Ireland, Woodbury; Thomas R. Stein, Cherry Hill, both of N.J.

[73] Assignee: Mobil Oil Corporation, New York, N.Y.

[21] Appl. No.: 614,588

[22] Filed: Sept. 18, 1975

[51] Int. Cl.[2] ..... C07C 1/04

[52] U.S. Cl. ..... 260/676 R; 208/79; 208/88; 208/93; 208/120; 208/135; 260/449 R; 260/450

[58] Field of Search ..... 260/676 R, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Paterson | 208/79 |
| 3,700,585 | 10/1972 | Chen et al. | 208/111 |
| 3,729,409 | 4/1973 | Chen | 208/135 |
| 3,843,510 | 10/1974 | Morrison et al. | 208/111 |
| 3,928,483 | 12/1975 | Chang et al. | 260/668 R |

OTHER PUBLICATIONS

Asinger, Paraffims Chemistry & Technology, Pergammon Press, N.Y., (1968), pp. 3, 123–125, 131, 132, 136, 138.

*Primary Examiner*—C. Davis

*Attorney, Agent, or Firm*—Charles A. Huggett; Carl D. Farnsworth

[57] ABSTRACT

A Fischer-Tropsch synthesis effluent is separated into gaseous, gasoline boiling, light fuel oil and heavy fuel oil products for upgrading to more desirable products by conversion over a special class of crystalline zeolites suitable for the purpose. Water washing of the separated fractions may be practiced to recover oxygenates from any separated fraction before further upgrading of oxygenates and hydrocarbons.

8 Claims, 1 Drawing Figure

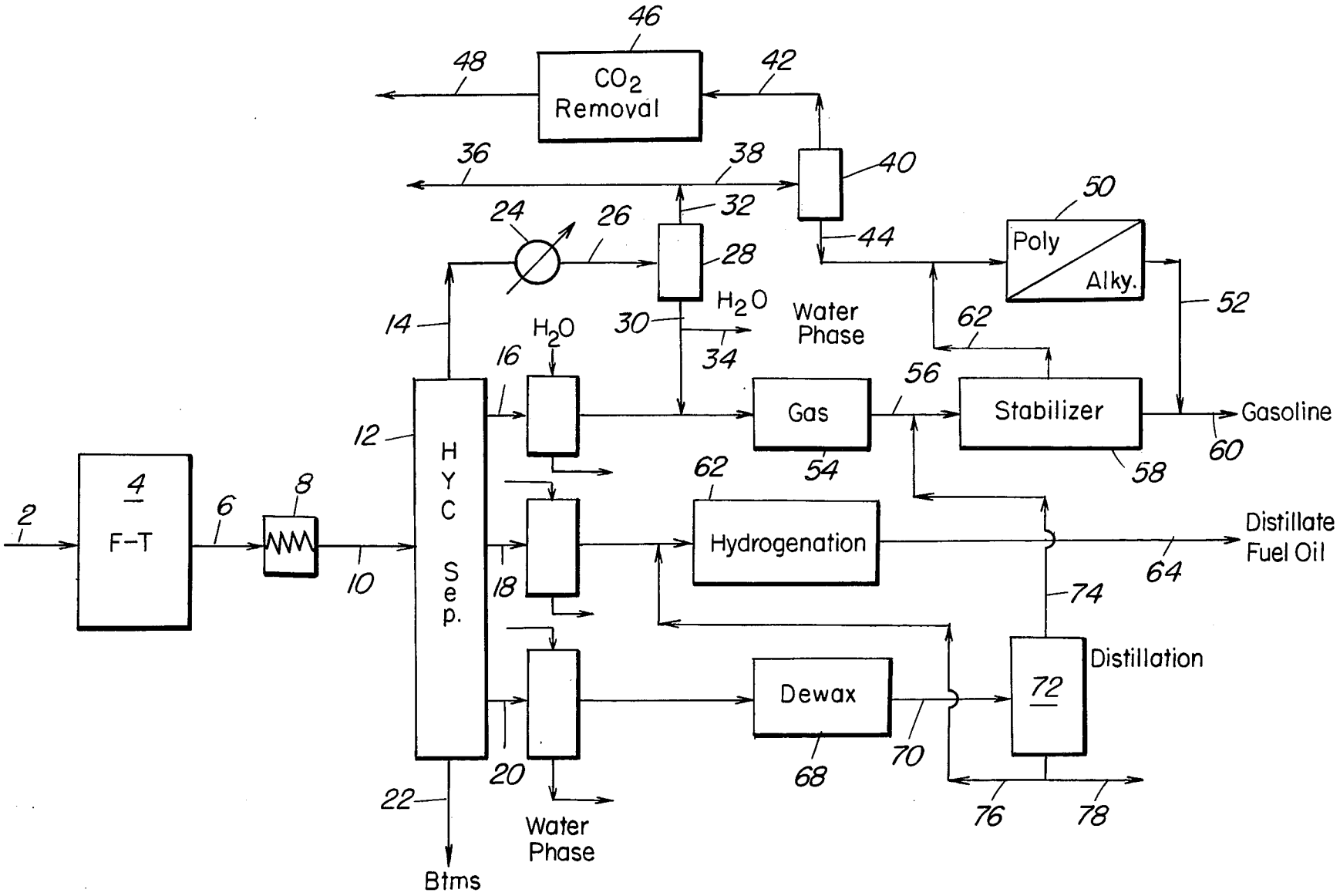
Gasoline
Distillate Fuel Oil
Distillation
Poly
Alky.
Stabilizer
Water Phase
Gas
Hydrogenation
Dewax
$CO_2$ Removal
$H_2O$
$H_2O$
Water Phase
H Y C Sep.
Btms
F-T
2
4
6
8
10
12
14
16
18
20
22
24
26
28
30
32
34
36
38
40
42
44
46
48
50
52
54
56
58
60
62
62
64
68
70
72
74
76
78

METHOD FOR ALTERING THE PRODUCT DISTRIBUTION OF FISCHER-TROPSCH SYNTHESIS PRODUCT

BACKGROUND OF THE INVENTION

This invention is concerned with a method or process for converting synthesis gas, such as mixtures of gaseous carbon oxides with hydrogen or hydrogen donors to form hydrocarbon mixtures and oxygenates. The invention is concerned with an arrangement of processing steps for increasing the yields of high octane gasoline boiling components and light oil materials suitable for use as diesel fuel over that obtained heretofore in the known Fischer-Tropsch synthesis gas conversion process. In still another aspect, this invention is concerned with the use of a novel class of crystalline zeolites represented by ZSM-5 crystalline zeolite for improving the product distribution obtained from a Fischer-Tropsch synthesis gas conversion operation.

The worlds largest oil from coal producing plant is known as the Sasol project in South Africa where petroleum products and chemicals are produced from high ash bituminous coal. The Sasol project words two variations of the Fischer-Tropsch synthesis gas conversion operation using a fixed and fluid catalyst bed system. This Sasol project has been described in British Chemical Engineering for the months May, June and July 1957. One portion of the these articles of particular interest is concerned with the product recovery that is discussed in the July 1957 article.

The Sasol project referred to above and built to convert an abundant supply of coal to hydrocarbons, oxygenates and chemicals was a pioneering venture. The process complex developed is enormous by any standard and quite expensive to operate. Therefore any advances which can be made to improve the yield of desired products without significantly increasing operating expense is viewed as one of major importance. The processing concepts of this invention are considered to fall in that category.

Other Prior Art

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in Encyclopedia of Chemical Technology, Edited by Kirk-Othmer, Second Edition, Volume 10, pages 353–433, (1966), Interscience Publishers, New York, N.Y., the contents of which are herein incorporated by reference. The techniques for gasification of coal or other solid, liquid or gaseous fuel are not considered to be per se inventive here.

It is considered desirable to effectively and more efficiently convert synthesis gas, and thereby coal and natural gas, to highly valued hydrocarbons such as motor gasoline with high octane number, petrochemical feedstocks, liquefiable petroleum fuel gas, and aromatic hydrocarbons. It is well known that synthesis gas will undergo conversion to form reduction products of carbon monoxide, such as hydrocarbons, at from about 300° F to about 850° F under from about one to one thousand atmospheres pressure, over a fairly wide variety of catalysts. The Fischer-Tropsch process, for example, which has been most extensively studied, produces a range of products including liquid hydrocarbons, a portion of which have been used as low octane gasoline. The types of catalysts that have been studied for this and related processes include those based on metals or oxides of iron, cobalt, nickel, ruthenium, thorium, rhodium and osmium.

The wide range of catalysts and catalysts modifications disclosed in the art and an equally wide range of conversion conditions for the reduction of carbon monoxide by hydrogen provide considerable flexibility toward obtaining selected boiling-range products. Nonetheless, in spite of this flexibility, it has not proved possible to make such selections so as to produce liquid hydrocarbons in the gasoline boiling range which contain highly branched paraffins and substantial quantities of aromatic hydrocarbons, both of which are required for high quality gasoline, or to selectively produce aromatic hydrocarbons particularly rich in the benzene to xylenes range. A review of the status of this art is given in "Carbon Monoxide-Hydrogen Reactions", Encyclopedia of Chemical Technology, Edited by Kirk-Othermer, Second Edition, Volume 4, pp. 446–488, Interscience Publishers, New York, N.Y. the text of which is incorporated herein by reference.

SUMMARY OF THE INVENTION

This invention is concerned with altering the product distribution of a Fischer-Tropsch synthesis gas operation. In a particular aspect the present invention is concerned with improving the yield of distillate fuel oil and octane upgrading gasoline product of the combination operation. A unique feature of the combination operation of this invention is the processing of the total Fischer-Tropsch reactor hot effluent through a product distillation column with only trim heating or cooling as required before entering the column. A further unique feature of this invention is concerned with the catalytic upgrading of selective fractions separated from the distillation column with or without water washing to recover or convert selected oxygenated products of the Fischer-Tropsch synthesis operation. Thus in the combination of this invention, all or some of the oxygenated products may be recovered or processed through the catalytic upgrading steps comprising the combination operation of this invention.

The distillation column separating the Fischer-Tropsch synthesis products as above briefly defined provides an overhead hydrocarbon stream comprising $C_4$ and lower boiling components which are processed to gasoline boiling range material by one or both of catalytic polymerization, alkylation or contact with the special class of crystalline zeolite herein defined to form light oil distillate materials and some gasoline. A first side stream provided by the column is an Fischer-Tropsch synthetic naphtha recovered with an end point within the range of about 320° F up to about 400° F and more usually within the range of about 330°–360° F in order to satisfy the flash point specification of an adjacent light distillate fuel oil product recovered from the column. The Fischer-Tropsch naphtha thus recovered is then processed over the special class of crystalline zeolite catalyst as hereinafter more specifically defined.

A second side stream is recovered boiling in the range of about 320° F to about 600° F depending upon the end point selected for the recovered naphtha as above defined. This second side stream is referred to herein as a light distillate fuel oil or jet fuel fraction cut to an end point required to meet pour point or freeze point specifications. This light distillate fuel oil fraction is mildly hydrotreated to meet fuel oil stability and color specifications. The yield of light fuel oil is increased by the modified distillation scheme herein proposed which includes adding the 320 to 550 fraction formerly retained in the gasoline pool with the 350° to 600° F light fuel oil material. Alternately, it is processed to meet jet fuel boiling ranges and freeze point specifications by processing over the special class of crystalline zeolites herein described. A third side stream is recovered from the distillation column boiling in the range of about 600° F to about 850° F. This heavy highly olefinic and paraffinic material is then subjected to hydrodewaxing conditions in the presence of the special class of crystalline zeolites herein defined under conditions to reduce pour point to specification distillate fuel oil level (20° F pour point). In this hydrodewaxing operation, a gasoline product material is formed of about 89 clear RON which is recovered and blended in the gasoline pool of the process. A 330° F+ distillate fraction recovered from the hydrodewaxing operation is then mildly hydrotreated with the light distillate oil recovered as above defined to improve color and storage stability and provide a full range product meeting distillate fuel oil specifications. As mentioned above, the naphtha, light and heavy fuel oil streams may be first separately water washed to separately recover oxygenates from any stream before further processing as above discussed or any oxygenated products retained in the respective side streams may be converted during subsequent catalytic treatment as herein provided.

The special zeolite catalysts referred to herein utilize members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anoinic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by eight-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calulated as follows:

$$\text{Constraint Index} = \frac{\log_{10}}{\log_{10}}$$

-continued $$\frac{\text{(fraction of n-hexane remaining)}}{\text{(fraction of 3-methylpentane remaining)}}$$

The constraint index approximates the ratio of the cracking rate constraints for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-described Constraint Index is an important and even critical, definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the "Constraint Index" value as used herein is an inclusive rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein be reference.

ZSM-12 is more particularly described in U.S. Pat. No. 3,832,449, the entire contents of which are incorporated herein by reference.

U.S. application Ser. No. 358,192, filed May 7, 1973, and now abandoned, the entire contents of which are incorporated herein by reference, describes a zeolite composition, and a method of making such, designated as ZSM-21 which is useful in this invention.

U.S. application Ser. No. 528,061 filed Nov. 29, 1974, the entire contents of which are incorporated herein by reference, describes a zeolite composition including a method of making it. This composition is designated ZSM-35 and is useful in this invention.

U.S. application Ser. No. 528,060, filed Nov. 29, 1974, and now abandoned the entire contents of which are incorporated herein by reference, describes a zeolite composition including a method of making it. This composition is designated ZSM-38 and is useful in this invention.

The x-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction an calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April, 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

The drawing is a diagrammatic sketch in elevation of a block flow arrangement for processing Fischer-Tropsch Synthesis products to increase the yields of distillate fuel oil and octane rating of the gasoline product of the process.

Referring now to the drawing, a synthesis gas feed comprising oxides of carbon and hydrogen are introduced by conduit 2 to a Fischer-Tropsch synthesis gas conversion operation in zone 4. The Fischer-Tropsch synthesis gas operation is carried out under conditions promoting the formation of hydrocarbon products and oxygenates. The total effluent of the Fischer-Tropsch synthesis operation is then passed at its reaction temperature by conduit 6 to a zone 8 which may be a heating or cooling zone to adjust the temperature of the effluent suitable for passage by conduit 10 a hydrocarbon separation zone 12. In the hydrocarbon separation zone or section 12, a separation is made in a specific arrangement to recover a gaseous stream comprising $C_4$ and lower boiling component by conduit 14, a synthetic naphtha fraction comprising hydrocarbons boiling from about $C_5$ hydrocarbons up to about 320° F being withdrawn by conduit 16, a light fuel oil fraction boiling from about 320° F up to about 600° F being withdrawn by conduit 18 and a heavy fuel oil product boiling from about 600° to 850° F being withdrawn by conduit 20. Material higher boiling than about 850° F is withdrawn from the bottom of the separation section by conduit 22.

As mentioned above, the hydrocarbon fractions withdrawn as by conduits 16, 18, and 20 may be separately water washed to remove entrained oxygenates or the oxygenates may be carried with the hydrocarbon stream to further catalytic treatment as herein provided.

Infra red spectra analysis of the full range decanted oil of the Fischer-Tropsch synthesis operation shows three strong carbonyl bonds indicating the presence of aldehydes, ketones, and esters. Literature articles mention the presence of phenols (carbolic acid), cresols, xylenols and higher boiling acids. Water (or caustic) wash of the individual side streams above identified makes possible the separate recovering of these oxygenated compound types in their specific boiling ranges. The specific oxygenated compounds present have not been completely and specifically identified but several of the compounds can be listed as provided in the following table.

TABLE 1

| Compound | B.P., ° F at 14.7 psia |
|---|---|
| Alcohols | |
| 1-Propanol (n-propyl alcohol) | 206.9 |
| 2-Propanol (isopropyl alcohol) | 180.1 |
| 1-Butanol (Butyl alcohol) | 243.9 |
| 2-Butanol (se-butyl alcohol) | 211.1 |
| 2-Methyl-2-Propanol | 180.6 |
| 1-Pentanol (Amyl alcohol) | 280.4 |
| 1- Hexanol | 314.7 |
| 1-Heptanol | 349.2 |
| 1-Octanol | 383.4 |
| Ethers | |
| Dimethyl Ether | −12.6 |
| Diethyl Ether | 94 |
| Di-n-propyl Ether | 193.6 |
| Diisopropyl Ether | 155.3 |
| Dibutyl Ether | 287.6 |
| Misc. | |
| O-cresol | 375 |
| m-cresol | 397 |
| p-cresol | 395 |
| Keontes | |
| Dimethyl Ketone | 215.2 |
| Methyl n-Butyl Ketone | 261.5 |
| Methyl n-Amyl Ketone | 304.5 |
| Methyl Hexylketone | 343.9 |
| Aldehydes | |
| Butyraldehyde | 166.6 |
| Isobutyraldehyde | 147.4 |

In the specific arrangement of the drawing, a gaseous fraction comprising $C_4$ and lower boiling components withdrawn by conduit 14 is cooled in cooler 24 to a temperature of about 70° F. before passage by conduit 26 to a separation zone 28. In separation zone 28, a separation is made to recover a water phase withdrawn by conduit 30 from a gaseous hydrocarbon phase comprising $C_4$ and lower boiling materials including unreacted synthesis gas. The separated water phase may be withdrawn by conduit 34 for further processing as discussed or it may be added to the synthetic naphtha fraction in conduit 16 for processing as hereinafter discussed. The gaseous hydrocarbon fraction may be recycled to the Fischer-Tropsch synthesis operation in zone 4 by conduit 36. On the other hand, this gaseous material stream may be passed by conduit 38 to separation zone 40 wherein a separation is made to recover $C_2$ minus material withdrawn by conduit 42 from gaseous materials comprising $C_2$–$C_5$ hydrocarbon recovered by conduit 44. The $C_2$ minus material in conduit 42 may be used all or in part as fuel gas or it may be treated to remove $CO_2$ therefrom in zone 46 before recycle to a synthesis gas forming zone not shown by conduit 48. The $C_2$ to $C_5$ material in conduit 44 is then passed to zone 50 which may be a catalytic polymerization zone, an alkylation zone or processed over the special class of crystalline zeolites herein deferred to form gasoline and light fuel oil boiling range materials. Gasoline boiling range products are recovered and withdrawn from zone 50 by conduit 52.

The synthetic naphtha or gasoline fraction boiling in the range of about $C_5$ to 320° F or variations thereof withdrawn by conduit 16 is passed to zone 54 wherein the gasoline fraction is brought in contact with a crystalline zeolite such as ZSM-5 crystalline zeolite under temperature and pressure conditions promoting the formation of gasoline product of improved octane rating. Temperatures in the range of 500 to 800° F and pressures within the range of 0 to 100 psig may be employed with significant advantage. Furthermore, when including the oxygenates in the gasoline fraction and those in the water phase of conduit 30 with the naphtha fraction above identified as charge to the operation, the oxygenates are converted to gasoline boiling components and lower boiling constituents which are separated as herein defined.

A gasoline product of substantially improved octane rating such as one improved from about 55 octane to about 90 octane is recovered with lower boiling component from the crystalline zeolite conversion zone 54 by conduit 56 for passage to stabilizaton or distillation zone 58. In stabilization zone 58, $C_5$ and lower boiling components are separated from a $C_5$ plus gasoline product fraction. The stabilized gasoline of desired vapor pressure is withdrawn by conduit 60 as product of the process. Gaseous components, $C_4$ and lower boiling material separated from the gasoline product in stabilizer is removed therefrom by conduit 62 communicating with conduit 44 for further treatment thereof as discussed above.

As mentioned above, the combination process of this invention is concerned with substantially increasing the yield of fuel oil of desired characteristics. To reach this end, a light fuel oil fraction boiling from about 320° F to about 600° F is recovered by conduit 18 for further treatment as by water wash to remove oxygenates or passed directly without water wash to hydrogenation zone 62 to improve its characteristics as a fuel oil product.

The oxygenates in the light fuel oil may be passed along therewith and converted in the hydrogenation step to suitable fuel oil product. Hydrogenation of the fuel oil in zone 62 is accomplished under relatively mild conditions comprising a hydrogen pressure within the range of 200 to 1000 pounds; a temperature within the range of 500° to 800° F and a liquid hourly space velocity (LHSV) within the range of 0.5 to 5. A cobalt-molybdenum or nickel-molybdenum on alumina or other known hydrogenation catalysts are suitable for accomplishing the hydrogenation desired. Light distillate fuel oil is recovered by conduit 64. The yield of distillate product is further improved by processing the separated 600°–850° F product fraction in conduit 20 in the following manner. This heavy low fluidity fraction may be water washed to remove entrained oxygenates if desired or they may be included with the waxy feed processed as hereinafter discussed. In this step of the combination operation, the heavy waxy material boiling in the range of about 600° to about 850° F in conduit 20 is passed to a catalytic hydrodewaxing operation in zone 68 wherein the heavy waxy feed is brought in contact with a catalyst combination promoting hydrogenation of the charge, selective cracking of the high pour paraffins and olefinic components of the feed, and the production of fuel oil material of acceptable pour characteristics as well as a gasoline product of high octane rating. In this hydrodewaxing operation, the catalyst is a crystalline zeolite of the ZSM-5 class of crystalline zeolites used alone promoted with a hydrogenation component or used in combination with a cobalt-molybdenum on alumina hydrogenation component preceding the zeolite catalyst component. Other well known hydrogenation components could also be employed.

Table 2 below particularly concerns itself with the operating conditions and distillate yield estimated for hydrodewaxing a 600°–850° F boiling range Fischer-Tropsch product having a 115° F pour point. The decanted oil fraction of Fischer-Tropsch synthesis is about 33 weight percent of the total oil obtained. The yield of hydrodewaxed distillate meeting pour point specifications made from the 600 ° to 850° F charge was around 80%. The gasoline product of this hydrodewaxing operation was 89 clear and 97 R+3 octane and can be blended directly into the gasoline pool of the process.

TABLE 2

MAXIMIZING FUEL OIL PRODUCT FROM FISCHER-TROPSCH SYNTHESIS PRODUCT

| Fischer-Tropsch Decant Oil | Wt.% | Vol.% |
|---|---|---|
| Light Distillate | 33.0 | 35.0 |
| 600–850° F Heavy Distillate | 52.0 | 52.0 |
| 850+° F Bottoms | 15.0 | 13.0 |
| Operating Conditions | | |
| $H_2$ Pressure, psi | 400 | |
| LHSV, V/Hr/V | 1.5 | |
| $H_2$ Circulation, SCF/L | 2500 | |
| Temperature ° F | 550–750 | |
| Hydrodewaxer Yields | Wt.% | Vol.% |
| (Chg: 600–850° F Hvy Dist, 29.5° API) | | |
| $H_2O$ | 11.47 | — |
| $C_1$ | 0.03 | — |
| $C_2$ | 0.07 | — |
| $C_3$ | 0.72 | — |
| $C_4$ | 2.5 | 3.8 |
| $C_5$ | 3.0 | 4.1 |
| $C_6$–330° F Naphtha | 13.2 | 15.3 |
| 330+° F Distillate | 79.3 | 79.2 |
| | 100.32 | |
| Hydrogen Consumption, SCF/B | 190 | |
| Product Quality | | |
| $C_6$ - 330° F Naphtha | | |
| Gravity, ° API | 55.0 | |
| Paraffins | 28 | |
| Olefins | 35 | |
| Naphthenes | 13 | |
| Aromatics | 24 | |
| Octane R + O/R + 3 | 89/97 | |
| HDW Distillate | | |
| Gravity, ° API | 29.2 | |
| Pour Point, ° F. | 20 | |
| Aniline Point | 128 | |
| Viscosity, KV at 100° F, cs | 6.01 | |

Thus, in accordance with that discussed above with respect to Table 2, the product of hydrodewaxing in zone 68 is passed by conduit 70 to a distillation zone 72 wherein a separation is made between gasoline and lower boiling components withdrawn by conduit 74 for passage to stabilizer 58 and fuel oil product withdrawn by conduit 76 are passed to hydrogenation zone 62. It is also contemplated withdrawing this heavy fuel oil as a product of the process by conduit 78 without any further hydrogenation thereof.

A small amount of 850° F plus bottoms material such as recovered by conduit 22 may be employed as provided in Table 2. On the other hand, this material may be used as fuel or disposed off by any suitable manner convenient to the refiner. In the combination operation of this invention, it is contemplated separating the recovered oxygenates for chemical processing as desired. On the other hand, the separated oxygenates may be separately converted to hydrocarbons with the special class of crystalline zeolites discussed above. In yet another embodiment, it is contemplated separating for example excess ethanol not desired for conversion to ethylene and converting the excess ethanol to hydrocarbons in the gasoline boiling range with the special class of crystalline zeolites.

Having, thus, generally described the present invention and discussed specific embodiments in support thereof, it is to be understood that no undue restrictions are to be imposed by reason thereof except as defined by the following claims.

We claim:

1. A method for upgrading the products of Fischer-Tropsch synthesis which comprises, separating the product effluent of Fischer-Tropsch synthesis into a gaseous fraction comprising $C_5$ and lower boiling components, a $C_5$ plus gasoline fraction, a light oil fraction boiling in the range extending from said gasoline fraction up to about 600° F, and a high boiling waxy fraction, cooling said gaseous fraction under conditions to separate and recover a water phase from a gaseous hydrocarbon phase comprising $C_5$ and lower boiling gaseous components, separating the gaseous hydrocarbon phase to recover a fraction rich in $C_2$ to $C_5$ hydrocarbons thereafter catalytically converted to gasoline boiling range components, passing $C_5$ plus gasoline boiling material in contact with a crystalline zeolite conversion catalyst selective for producing a gasoline product of improved octane rating and separating the gasoline of improved octane rating from lower boiling gaseous material, passing the separated high boiling waxy fraction in contact with a hydrodewaxing catalyst selective for producing a dewaxed light oil fraction and a gasoline fraction of relatively high octane rating subsequently separated from one another, combining the dewaxed light oil fraction produced above with said separated light oil product of Fischer-Tropsch snythesis and passing the combined light oil material in contact with a hydrogenation catalyst maintained under hydrogenating conditions, recovering a hydrogenated light oil product and recovering the gasoline products of the improving combination.

2. The method of claim 1 wherein one or more of the separated fractions of the Fischer-Tropsch effluent is subjected to water wash to recover oxygenates therefrom before further processing of the hydrocarbon phase.

3. The method of claim 1 wherein the water phase separated from the $C_5$ minus gaseous fraction after cooling thereof is combined with $C_5$ plus gasoline fraction passed in contact with said crystalline zeolite conversion catalyst.

4. The method of claim 1 wherein the water phase separated from the $C_5$ minus gaseous material is combined with a water wash phase obtained by water washing the separated $C_5$ plus gasoline boiling material.

5. The method of claim 4 wherein lower alcohols are recovered from the water phase and charged with hydrocarbon material passed in contact with a ZSM-5 crystalline zeolite conversion catalyst to form gasoline boiling components.

6. The method of claim 1 wherein oxygenates are recovered from each of said light oil fraction and said high boiling waxy fraction for conversion to chemicals.

7. The method of claim 1 wherein the water phase separated from the $C_5$ minus gaseous fraction is separately processed for chemicals recovery and excess lower alcohols are processed over a ZSM5 crystalline zeolite catalyst to produce gasoline boiling components.

8. The method of claim 1 wherein gasoline boiling products obtained by the improving combination are blended.

* * * * *